US006179993B1

(12) United States Patent
Seimandi et al.

(10) Patent No.: US 6,179,993 B1
(45) **Date of Patent: *Jan. 30, 2001**

(54) PROCESS FOR OBTAINING OLEFINS FROM RESIDUAL FEEDSTOCKS

(75) Inventors: Noel M. Seimandi, Brussels (BE); Tony T. Cheng, Seabrook, TX (US); Willibald Serrand, Buxheim (DE); Mitchell Jacobson, West Orange, NJ (US); Paul K. Ladwig, Randolph, NJ (US); John F. Pagel, Morris Plains, NJ (US); Michael R. Parrish, Morristown, NJ (US); Hans A. Weisenberger, Tervuren (BE)

(73) Assignee: Exxon Chemical Patents Inc., Houston, TX (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/803,209

(22) Filed: Feb. 21, 1997

Related U.S. Application Data

(63) Continuation-in-part of application No. 08/606,153, filed on Feb. 23, 1996

(60) Provisional application No. 60/026,416, filed on Sep. 20, 1996, provisional application No. 60/025,743, filed on Sep. 20, 1996, provisional application No. 60/026,427, filed on Sep. 20, 1996, and provisional application No. 60/026,376, filed on Sep. 20, 1996.

(51) Int. Cl.[7] ..... C10G 73/02

(52) U.S. Cl. ..... 208/27; 208/127; 585/648

(58) Field of Search ..... 208/27, 127; 585/648

(56) References Cited

U.S. PATENT DOCUMENTS

| | | | |
|---|---|---|---|
| 2,385,446 | 9/1945 | Jewell et al. | 196/52 |
| 2,432,962 | 12/1947 | Bergstrom | 196/55 |
| 2,436,160 | 2/1948 | Blanding | 196/55 |
| 2,731,508 | 1/1956 | Jahnig et al. | 260/683 |
| 2,737,479 | 3/1956 | Nicholson | 196/55 |
| 2,768,127 | 10/1956 | Kimberlin, Jr. et al. | 196/55 |
| 2,776,727 | 1/1957 | Boisture | 183/82 |
| 3,074,878 | 1/1963 | Pappas | 208/127 |
| 3,365,387 | 1/1968 | Cahn et al. | 208/48 |
| 3,717,438 | 2/1973 | Schmalfeld et al. | 23/262 |
| 4,057,490 | 11/1977 | Wynne, Jr. | 208/127 |
| 4,061,562 | 12/1977 | McKinney et al. | 208/61 |
| 4,172,857 | 10/1979 | Pavilon | 585/635 |
| 4,186,079 | 1/1980 | Roberts | 208/127 |
| 4,259,117 | 3/1981 | Yamauchi et al. | 106/35 |
| 4,379,046 | 4/1983 | Oldweiler | 208/54 |
| 4,437,979 | 3/1984 | Woebcke et al. | 208/153 |
| 4,454,022 | 6/1984 | Shoji et al. | 208/48 |
| 4,552,645 | 11/1985 | Gartside et al. | 208/80 |
| 4,828,681 | 5/1989 | Yourtee et al. | 208/127 |
| 4,859,284 | 8/1989 | Rammler et al. | 201/12 |
| 4,975,181 | 12/1990 | Tsao | 208/127 |
| 4,980,053 | 12/1990 | Li et al. | 208/120 |

FOREIGN PATENT DOCUMENTS

| | | |
|---|---|---|
| 1083092A | 3/1994 | (CN) . |
| 938844 | 2/1956 | (DE) . |
| 315179 | 5/1989 | (EP) . |
| 49-128003 | 12/1974 | (JP) . |
| 51-5402 | 1/1976 | (JP) . |
| 52-42762 | 9/1977 | (JP) . |
| 58-49784 | 3/1983 | (JP) . |
| 6806323 | 11/1968 | (NL) . |
| WO 97/04043 | 2/1997 | (WO) . |

OTHER PUBLICATIONS

"A New Process for Ethylene Production—Heavy Oil Contact Cracking Process", Petroleum Processing and Petrochemicals, vol. 26, Jun., 1995, pp. 9–14.

"Olefins From Heavy Oils", Liquid Feed for Ethylene/Propylene—The New Wave, CEP, Jan. 1983, pp. 76–84.

"Ethlylene", Chemical Week, Nov. 13, 1965, pp. 70–81..

*Primary Examiner*—Helane E. Myers

(57) ABSTRACT

A process for obtaining a substantial amount of olefinic products from a residual feedstock by use of a vapor short contact time conversion process unit comprised of a bed of fluidized heat transfer solids. The vapor short contact time process unit is operated at conditions which includes steam dilution to reduce partial pressure of hydrocarbon vapors and a vapor residence time less than about 0.5 seconds.

12 Claims, 1 Drawing Sheet

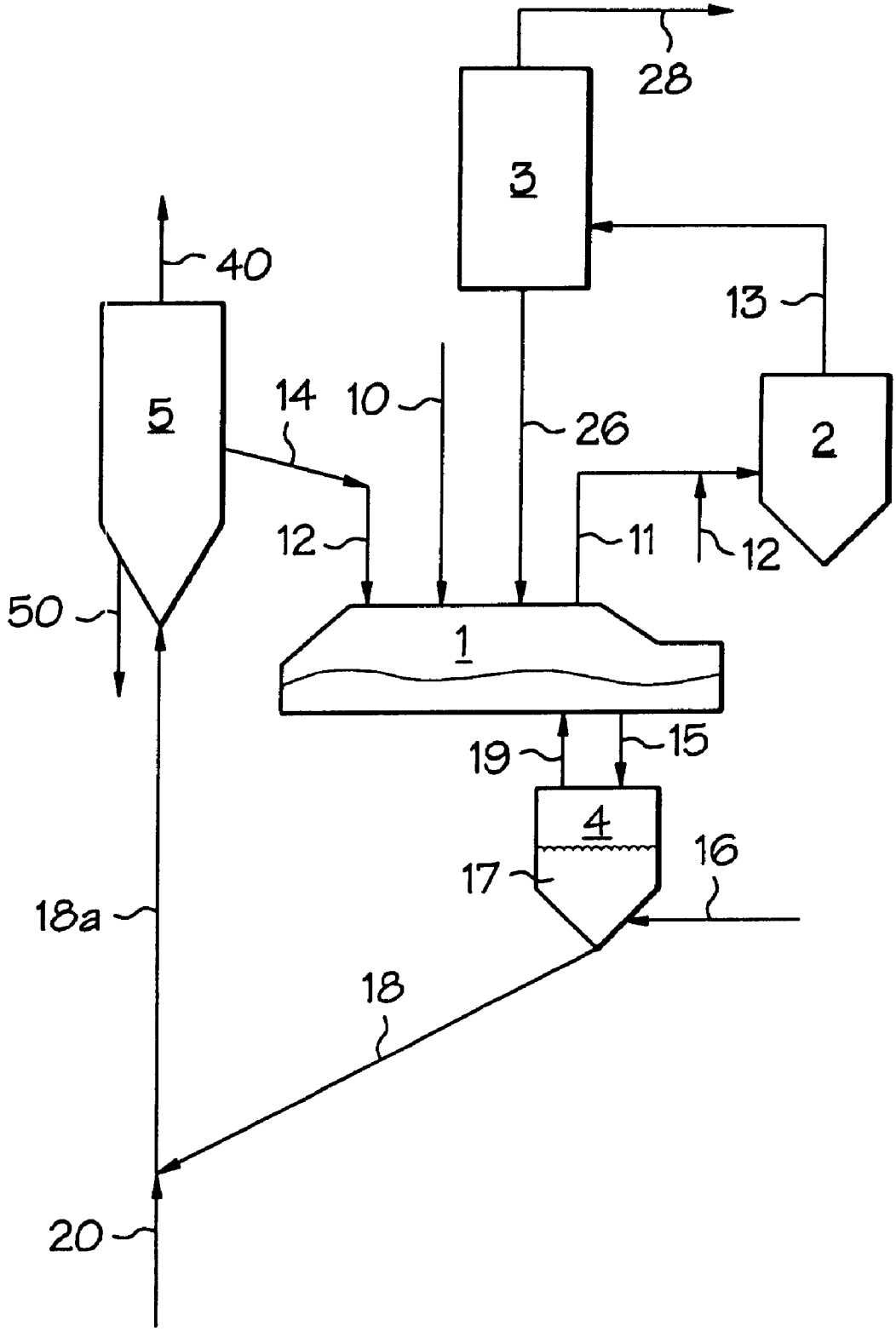
28
3
40
13
5
14
10
26
2
12
11
12
50
1
19
15
4
16
17
18a
18
20

PROCESS FOR OBTAINING OLEFINS FROM RESIDUAL FEEDSTOCKS

The present application is a continuation-in-part of application Ser. No. 08/606,153 filed Feb. 23, 1996; entitled "Process for Obtaining Significant Olefin Yields from Residua Feedstocks" currently pending (attorney docket number HEN-9517) and the present application claims priority to (1) Provisional application serial No. 60/026,416 filed Sep. 20, 1996 "Process for Obtaining Olefins from Lube Extracts and Other Refinery Waste Streams"; (2) Provisional application serial No. 60/025,743 filed Sep. 20, 1996 "Process for Obtaining Olefins from Residual Feedstocks"; (3) Provisional application serial No. 60/026,427 filed Sep. 20, 1996 "Dual Process for Obtaining Olefins"; and (4) Provisional application serial No. 60/026,376 filed Sep. 20, 1996 "Process for Obtaining Olefins from Residual Feedstocks". The present application is related to (1) application Ser. No. 08/803,664 filed on the same date as this application, entitled "Process for Obtaining Olefins from Lube Extracts and Other Refinery Waste Streams" by inventor P. A. Ruziska, et. al., and (2) application Ser. No. 08/803,664 filed on the same date as this application, entitled "Dual Process for Obtaining Olefins" by inventors W. Serrand, et. al. All of these applications are incorporated herein by this reference.

FIELD OF THE INVENTION

The present invention relates to a process for obtaining a substantial amount of olefinic products from a residual feedstock by use of a vapor short contact time conversion process unit comprised of a bed of fluidized heat transfer solids. The vapor short contact time process unit is operated at conditions which includes steam dilution to reduce partial pressure of hydrocarbon vapors and a vapor residence time less than about 0.5 seconds.

BACKGROUND OF THE INVENTION

In a typical refinery, crude oils are subjected to atmospheric distillation to produce lighter fractions such as gas oils, kerosenes, gasolines, straight run naphtha, etc. Petroleum fractions in the gasoline boiling range, such as naphthas, and those fractions which can readily be thermally or catalytically converted to gasoline boiling range products, such as gas oils, are the most valuable product streams in the refinery. The residue from the atmospheric distillation step is then distilled at a pressure below atmospheric pressure. This later distillation step produces a vacuum gas oil distillate and a vacuum reduced residual oil which typically contains relatively high levels of asphaltene molecules. These asphaltene molecules are responsible for most of the Conradson carbon residue and metal components in the resid. They also contain relatively high levels of heteroatoms, such as sulfur and nitrogen. These feeds have little commercial value, primarily because they cannot be used as a fuel oil owing to ever stricter environmental regulations. They also have little value as feedstocks for refinery processes, such as fluid catalytic cracking, because they produce excessive amounts of gas and coke. Also, their high metals content leads to catalyst deactivation. Thus, there is a great need in petroleum refining for greater utilization of such feedstocks for example by upgrading them to make them more valuable cleaner and lighter feeds.

A significant amount of feedstock in the gas oil boiling range is used to make olefins in steam cracking process units which contains a furnace comprised of fired tubes, or coils in which the feedstock is thermally cracked at temperatures of about 540° C. to 760° C. in the presence of steam. While gas oils are adequate feedstocks for such purposes, they are also relatively expensive feedstocks because of their preferred use for the production of transportation fuels. Residual feeds, which are substantially cheaper than gas oils, are typically unsuitable for use in steam crackers because of excessive cracking and coke formation in the furnace tubes leading to overheating and equipment plugging.

An attempt to overcome these problems was made in U.S. Pat. No. 2,768,127 which teaches the use of residual feedstocks for the production of aromatic and olefinic product streams. This was accomplished by contacting the residua feedstock in a fluidized bed of coke particles maintained at a temperature from about 675° C. to 760° C. While such attempts have been made to overcome these problems, there remains a need for improved processes having better control of solids and vapor residence times.

SUMMARY OF THE INVENTION

In accordance with the present invention, there is provided a process for producing olefins from a residual feedstock, which process comprises converting the feedstock in a process unit comprised of:

(i) a heating zone wherein heat transfer solids containing carbonaceous deposits thereon are received from a stripping zone and heated in the presence of an oxidizing gas;

(ii) a vapor short contact time reaction zone containing a bed of fluidized solids comprised of heat transfer solids recycled from the heating zone; and (iii) a stripping zone through which solids having carbonaceous deposits thereon are passed from the reaction zone and wherein lower boiling additional hydrocarbons and volatiles are recovered with a stripping gas; which process comprises:

(a) feeding the residual feedstock to said vapor short contact time reaction zone wherein it contacts the fluidized heat transfer solids and catalytic component, which reaction zone is operated at a temperature from about 760° C. to about 790° C. and under conditions such that the solids residence time and the vapor residence time are independently controlled, which vapor residence time is less than about 0.5 seconds, and which solids residence time is from about 5 to about 60 seconds, thereby resulting in a material being deposited onto said solids, and a vaporized fraction containing olefinic products, which material is characterized as a combustible carbonaceous metal-containing material, and wherein steam is fed at a rate from about 0.2 to 0.5 lbs per lb. of residual feedstock;

(b) separating the vaporized fraction from the solids;

(c) separating an olefin-rich fraction from said vaporized fraction;

(d) passing the separated solids to said stripping zone where they are contacted with a stripping gas, thereby removing any remaining volatile material therefrom;

(e) passing the stripped solids to said heating zone where they are heated to an effective temperature that will maintain the operating temperature of the reaction zone; and (f) recycling heated solids from the heating zone to the reaction zone where they provide the heat of reaction and are contacted with fresh feedstock.

In a preferred embodiment of the present invention, the vapor short contact reaction zone is comprised of a horizontal moving bed of fluidized heat transfer solids.

In other preferred embodiments of the present invention the residence time in the reaction zone for the solids is about 10 to 30 seconds and the residence time for the vapor is less than 1 second.

In still other preferred embodiments of the present invention, the feedstock is selected from the group consisting of vacuum resids, atmospheric resids, heavy and reduced petroleum crude oil; pitch; asphalt; bitumen; tar sand oil; shale oil; coal; coal slurries; and coal liquefaction bottoms.

In still other preferred embodiments of the present invention, the reaction zone is fluidized with the aid of both a mechanical means and a fluidizing gas comprised of vaporized normally gaseous hydrocarbons, hydrogen, hydrogen sulfide, and steam.

BRIEF DESCRIPTION OF THE FIGURE

The sole FIGURE hereof is a schematic flow plan of a non-limiting preferred embodiment of the present invention.

DETAILED DESCRIPTION OF THE INVENTION

Residual feedstocks which are suitable for use in the practice of the present invention are those hydrocarbonaceous streams boiling above about 480° C., preferably above about 540° C., more preferably above about 560° C. Non-limiting examples of such streams include vacuum resids, atmospheric resids, heavy and reduced petroleum crude oil, pitch, asphalt, bitumen, tar sand oil, shale oil, coal slurries, and coal liquefaction bottoms. Such streams may also contain minor amounts of lower boiling material. These streams are normally not used as feeds to steam crackers, which are the petrochemical process units used to produce olefinic products, because they will produce excessive amounts of coke which fouls the furnace tubes. Such feeds will normally have a Conradson carbon content of at least 5 wt. %, generally from about 5 to 50 wt. %, and typically above about 7 wt. %. Conradson carbon residue is measured in accordance with ASTM Test D189-65. The residual feedstocks will be converted to lower boiling products, including light olefins, in a vapor short contact time mechanically fluidized process unit which will be discussed below.

A co-feed, preferably a refinery waste stream, may also be used with the residual feedstock in accordance with the present invention. Non-limiting examples of suitable co-feeds include: lube extracts, deasphalted rock, heavy products from fluidized catalytic cracking boiling in excess of about 260° C., and petrolatum. Up to about 50 wt. % of the feed stream to the reaction zone can be the co-feed portion. It is preferred that no more that about 10 wt. %, more preferably no more than about 25 wt. % of the total feed stream be the co-feed portion.

"Lube extract", for purposes of the present invention is that portion of a lube oil feedstock which is dissolved in and removed by a selective solvent. Typically, solvent extraction is used to improve: (i) the viscosity index, (ii) oxidation resistance, (iii) color of the lube oil base stock, and (iv) to reduce the carbon- and sludge- forming tendencies of the lubricants by separating the aromatic portion from the naphthenic and paraffinic portion. The most common solvents used are furfural, phenol, and N-methyl-2-pyrrolidone (NMP). A lube extract will typically be comprised of about: 10 to 30 wt. % saturates, 15 to 25 wt. % one ring compounds, 20 to 30 wt. % two ring compounds, 10 to 20 wt. % three ring compounds, 5 to 20 wt. % four ring compounds, and 1 to 10 wt. % polars, wherein said weight percents are based on the total weight of the extract. Petrolatum is a soft petroleum material obtained from petroleum residua and consisting of amorphous wax and oil.

Olefinic products are produced from the residual feedstocks in accordance with the present invention in a vapor short contact time process unit which is comprised of a heating zone, a vapor short contact time fluidized bed reaction zone, and a stripping zone. Reference is now made to the sole figure hereof which illustrates, in a simplified form, a preferred process embodiment of the present invention. Residual feedstock is fed via line 10 to vapor short contact time reaction zone 1 which contains a horizontal moving bed of fluidized hot heat transfer solids having a catalytic component having catalytic activity for the production of olefins. It is preferred that the solids in the vapor short contact time reactor be fluidized with assistance of a mechanical means. The fluidization of the bed of solids is assisted by use of a fluidizing gas comprised of vaporized normally gaseous hydrocarbons, hydrogen, hydrogen sulfide, and added steam. By "added steam" we mean that the steam is not generated during processing as are the other components of the fluidizing gas. Further, it is preferred that the mechanical means be a mechanical mixing system characterized as having a relatively high mixing efficiency with only minor amounts of axial backmixing. Such a mixing system acts like a plug flow system with a flow pattern which ensures that the residence time is nearly equal for all particles. The most preferred mechanical mixing system is the mixer of the type referred to by Lurgi AG of Germany as the LR-Mixer or LR-Flash Coker which was originally designed for processing for oil shale, coal, and tar sands. The LR-Mixer consists of two horizontally oriented rotating screws which aid in fluidizing the solids.

The heat transfer solids will normally be substantially catalytically inert, relative to the catalytic component, toward the production of olefins. The heat transfer solids serve as the heat carrier for bringing heat from the heater to the reaction zone for the thermal production of olefins. When a catalytic component is also present, increased amounts of olefins will be made. That is, olefins will be produced by both thermal and catalytic means. The catalytic activity of the catalytic component will have an effective activity. By effective activity we mean that the catalytic activity is controlled so that relatively high levels of olefins are produced without the formation of unacceptable amounts of undesirable reaction products, such as methane. The heat transfer solids will typically be petroleum coke from a delayed coking process, recycle coke from the instant process unit, or an inert material such as sand. Non-limiting examples of materials which can be used as the catalytic component include refractory metal oxides and aluminates, zeolites, spent fluid catalytic cracking catalysts, vanadium rich flue fines, spent bauxite, and mixtures thereof. The term "spent bauxite", also sometimes referred to as "red mud", as used herein, refers to the waste portion of bauxite left after aluminum production. Spent bauxite will typically be comprised of the remaining mineral matter, in oxide form, after aluminum production. A typical analysis of spent bauxite will be about 30 to 35 wt. % FeO(OH)-AlO(OH); about 15 to 20 wt. % $Fe_2O_3$; about 3 to 7 wt. % $CaCO_3$; about 2 to 6 wt. % $TiO_2$; and less than about 3 wt. % each of $SiO_2$ and $Mn_3O_4$. Other mineral matter may also be present in tramp amounts. Preferred refractory metal oxides are those wherein the metal is selected from Groups Ia, IIa, Va, VIa, VIIa, VIb, and VIIIa and the lanthanides, of the Periodic Table of the Elements. The Periodic Table of the Elements referred to herein is that published by Sargent-Welch Scientific Company, Catalog No. S-18806, Copyright 1980. Preferred are metal oxides selected from the group consisting of magnesium oxide, calcium oxide, manganese oxide, beryllium oxide, strontium oxide, cerium oxide, vanadium oxide, and cesium oxide.

If a catalytic component is used with the heat transfer solids, it is preferred to use at least an effective amount of said catalytic component. By "effective amount" we mean at least that amount needed to increase the olefins yield by at least 5%, preferably by at least 10%, and more preferably by at least 20%, in excess of the yield of olefins obtained when only the relatively inert heat transfer solids are used without the catalytic component under the same reaction conditions. Typically, the catalytic component will be of a substantially similar or smaller particle size than the heat transfer solids and will typically deposit on the surface of the heat transfer solids. The portion of catalytic component of the total solids will be at least 3 wt. %, preferably from about 10 to 25 wt. % of the total weight of the solids in the vapor short contact time reaction zone. The catalytic component can be introduced into the process at any appropriate location. For example, it can be introduced directly into the vapor short contact time reactor, it can be introduced with the feedstock, etc. In any event, if a mixture of substantially inert and catalytic solids are used, the catalytic solids will preferably be dispersed onto the surface of the inert solids, particularly if the major portion of solids is inert and the catalytic component is in powder form. The catalytic component may also be incorporated or dispersed into the relatively inert heat transfer solids. Although it is preferred that the heat transfer solids be coke particles, they may be any other suitable refractory particulate material. Non-limiting examples of such other suitable refractory particulate materials include those selected from the group consisting of silica, alumina, zirconia, and mullite, synthetically prepared or naturally occurring material such as pumice, clay, kieselguhr, bauxite, and the like. The heat transfer solids will preferably have an average particle size of about 40 microns to 2,000 microns, more preferably from about 200 microns to about 1000 microns, more preferably 400 microns to 800 microns. It is within the scope of the present invention that the catalytic component can represent 100% of the heat transfer solids.

The feedstock is contacted with the fluidized hot heat transfer solids, which will preferably be at a temperature from about 670° C. to about 870° C., more preferably from 780° C. to 850° C. A substantial portion of high Conradson carbon and metal-containing components from the feed will deposit onto the hot solids in the form of high molecular weight combustible carbonaceous metal-containing material. The remaining portion will be vaporized and will contain a substantial amount of olefinic products, typically in the range of about 10 to 50 wt. %, preferably from about 20 to 50 wt. %, and more preferably from about 30 to 50 wt. %, based on the total weight of the product stream. The olefin portion of the product stream obtained by the practice of the present invention will typically be comprised of about 5 to 15 wt. % methane; about 5 to 30 wt. %, preferably about 10 to 30 wt. % ethylene; and about 5 to 20 wt. % propylene, based on the feed.

The residence time of vapor products in reaction zone 1 will be an effective amount of time. That is, a short enough amount of time so that substantial secondary cracking does not occur. This amount of time will typically be less than about 2 seconds, preferably less than about 1 second, more preferably less than about 0.5 seconds, and most preferably less than about 0.25 seconds. The residence time of solids in the reaction zone will be from about 5 to 60 seconds, preferably from about 10 to 30 seconds. One novel aspect of the present invention is that the residence time of the solids and the residence time of the vapor products, in the vapor short contact time reaction zone, can be independently controlled. Conventional fluidized bed process units are such that the solids residence time and the vapor residence time cannot be independently controlled, especially at relatively short vapor residence times. It is preferred that the vapor short contact time process unit be operated so that the ratio of solids to feed be from about 40 to 1 to 10 to 1, preferably from about 25 to 1 to 15 to 1. The precise ratio of solids to feed for any particular run will primarily depend on the heat balance requirement of the vapor short contact time reaction zone. Associating the solids to oil ratio with heat balance requirements is within the skill of those having ordinary skill in the art, and thus will not be elaborated herein. A minor amount of the feedstock will deposit on the solids in the form of combustible carbonaceous material. Metal components will also deposit on the solids. Consequently, the vaporized fraction will be substantially lower in both Conradson Carbon and metals when compared to the original feed.

The vaporized fraction exits the reaction zone via line 11 and is quenched by use of a quench liquid which is introduced via line 12 to temperatures below that which substantial thermal cracking occurs. Preferred quench liquids are water, and hydrocarbon streams, such as naphthas and distillates oil. The temperature to which the vaporized fraction will be quenched will preferably be from about 50° to 100° C. below the temperature of the reaction zone. The vaporized fraction is then introduced into cyclone 2 where most of the entrained solids, or dust, is removed. The resulting dedusted vapors are then passed via line 13 to scrubber 3 where a light product stream is collected overhead via line 28. The light product stream will typically have an end boiling point of about 510° C. This light product stream will typically contain about 7 to 10 wt. % methane, 5 to 30 wt. % ethylene, and 5 to 20 wt. % propylene, and 6 to 9 wt. % unsaturated $C_4$'s, such as butanes and butadienes, based on the total weight of the feed. The remaining heavier stream is collected from the scrubber via line 26 and recycled to reaction zone 1.

Solids, having carbonaceous material deposited thereon are passed from reaction zone 1 via lines 15 to the bed of solids 17 in stripper 4. The solids pass downwardly through the stripper and past a stripping zone where any remaining volatiles, or vaporizable material, are stripped with use of a stripping gas, preferably steam, introduced into the stripping zone via line 16. Stripped vapor products pass upwardly in stripper vessel 4, through line 19 to reaction zone 1, then to cyclone 2 via line 11 and removed via line 13 with the light product stream. The stripped solids are passed via line 18 to heater 5 which contains a heating zone. The heating zone, which is a combination of heater 5 and transfer line 18*a*, is operated in an oxidizing gas environment, preferably with air, at an effective temperature. That is, at a temperature that will meet the heat requirements of the reaction zone. Air is injected via line 20 to support combustion of the carbonaceous components. The heating zone will typically be operated at a temperature from about 40° C. to 200° C., preferably from about 65° C. to 175° C., more preferably from about 65° C. to 120° C. in excess of the operating temperature of reaction zones 1.

It is to be understood that preheated air can also be introduced into the heater. The heater will typically be operated at a pressure ranging from about 0 to 150 psig (0 to 1136 kPa), preferably at a pressure ranging from about 15 to about 45 psig (204.8 to 411.7 kPa). While some carbonaceous residue will be burned from the solids in the heating zone, it is preferred that only partial combustion take place so that the solids, after passing through the heater, will have value as a fuel. Excess solids can be removed from the process unit via line 50. Flue gas is removed overhead from heater 5 via line 40. The flue gas can be passed through a cyclone system (not shown) to remove fines. Dedusted flue gas may be passed to a CO boiler (not shown) which includes a waste heat recovery system (not shown), and scrubbed to remove contaminants and particulates. The heated solids are then recycled via lines 12 and 14 to reaction zone 1. The catalyst component can be introduced anywhere in the process where practical. For example, it can be introduced into the heater 5, reactor 1, or with the feedstock in line 10.

The following example is presented to show that a short contact time process mode is important for obtaining increased olefin yields from residual feedstocks.

EXAMPLE

A South Louisiana Vacuum Residual was used as the feedstock and was fed at a feed rate of 100 barrels/day to a short contact time fluid coking pilot unit. The operating temperature of the pilot unit was 396° C. at a vapor residence time of less than 1 second. Estimated conversion and product yields are set forth in Table I below.

TABLE I

| | |
|---|---|
| Feed rate | 100 |
| Temperature ° C. | 745 |
| $C_3^-$ Conversion | 35 |
| Gas Yields wt. % on Feed | |
| Methane | 7–10 |
| Ethylene | 14–16 |
| Propylene | 9–12 |
| Unsaturated $C_4$'s | 6–9 |
| Liquid Yields wt. % on Feed | |
| $C_5$/220° C. | 17.5 |
| 220°/340° C. | 8.0 |
| 340° C.+ | 13.0 |
| Total $C_5$+ | 38.5 |
| Gross Coke, wt. % on Feed | 18.7 |
| Ethylene/Ethane | 6.0 |
| Propylene/Propane | 19.0 |
| Butylene/Butane | 30.0 |

What is claimed is:

1. A process for producing olefins from a residual feedstock, which process comprises converting the feedstock in a process unit comprised of:

(i) a heating zone wherein heat transfer solids containing carbonaceous deposits thereon are received from a stripping zone and heated in the presence of an oxidizing gas;

(ii) a vapor short contact time reaction zone containing a bed of fluidized solids comprised of heat transfer solids recycled from the heating zone; and (iii) a stripping zone through which solids having carbonaceous deposits thereon are passed from the reaction zone and wherein lower boiling additional hydrocarbons and volatiles are recovered with a stripping gas; which process comprises:

(a) feeding the residual feedstock to said vapor short contact time reaction zone wherein (it) the residual feedstock contacts the fluidized heat transfer solids and catalytic component, which reaction zone is operated at a temperature from about 760° C. to about 790° C. and under conditions such that the solids residence time and the vapor residence time are independently controlled, which vapor residence time is less than about 0.5 seconds, and which solids residence time is from about 5 to about 60 seconds, thereby resulting in a material being deposited onto said solids, and a vaporized fraction containing olefinic products, which material is characterized as a combustible carbonaceous metal-containing material, and wherein steam is fed at a rate from about 0.2 to 0.5 lbs per lb. of residual feedstock;

(b) separating the vaporized fraction from the solids;

(c) separating an olefin-rich fraction from said vaporized fraction;

(d) passing the separated solids to said stripping zone where they are contacted with a stripping gas, thereby removing any remaining volatile material therefrom;

(e) passing the stripped solids to said heating zone where they are heated to an effective temperature that will maintain the operating temperature of the reaction zone; and (f) recycling heated solids from the heating zone to the reaction zone where they provide the heat of reaction and are contacted with fresh feedstock.

2. The process of claim 1 wherein the solids residence time of the vapor short contact time reaction zone is from about 10 to 30 seconds.

3. The process of claim 1 wherein the residua feedstock is selected from the group consisting of vacuum resids, atmospheric resids, heavy and reduced petroleum crude oil; pitch; asphalt; bitumen; tar sand oil; shale oil; coal slurries; and coal liquefaction bottoms.

4. The process of claim 3 wherein the residua feedstock is a vacuum resid.

5. The process of claim 1 wherein (the) a catalytic component is present in the heat transfer solids which is selected from the group consisting of refractory metal oxides, aluminates, zeolites, spent fluid catalytic cracking catalysts, vanadium rich flue fines, spent bauxite, and mixtures thereof.

6. The process of claim 5 wherein the catalytic component is metal oxides selected from the group consisting of magnesium oxide, calcium oxide, manganese oxide, beryllium oxide, strontium oxide, cerium oxide, vanadium oxide, cesium oxide, and mixtures thereof.

7. The process of claim 1 wherein the heat transfer solids are selected from the group consisting of petroleum coke from a delayed coking process, recycle coke, (or) an inert material, (such as) or sand.

8. The process of claim 1 wherein the solids of the vapor short contact time reaction zone are fluidized with the aid of a mechanical means and a fluidizing gas.

9. The process of claim 8 wherein the fluidizing gas is comprised of normally gaseous hydrocarbons, hydrogen, hydrogen sulfide, and steam.

10. The process of claim 1 wherein a co-feed is used and is selected from the group consisting of lube extracts, deasphalted rock, heavy products from fluidized catalytic cracking boiling in excess of about 260° C., and petrolatum.

11. The process of claim 10 wherein less than 50 wt. % of the feedstock is said co-feed.

12. The process of claim 1 wherein the stripping gas is steam.

* * * * *